US005868634A

United States Patent [19]

Choi et al.

[11] Patent Number: 5,868,634

[45] Date of Patent: Feb. 9, 1999

[54] PRACTICE GOLF CLUB

[76] Inventors: Hi Zu Choi, Rua Sao Joaquim No. 516, Liberdade Sao Paulo, Brazil; Sung Min Choi, 315 E. Birmingham Rd., Burbank, Calif. 91504

[21] Appl. No.: 863,180

[22] Filed: May 27, 1997

[51] Int. Cl.[6] ..... A63B 69/36

[52] U.S. Cl. ..... 473/224; 473/232; 473/234; 473/256

[58] Field of Search ..... 473/223, 224, 473/232, 233, 234, 238, 258

[56] References Cited

U.S. PATENT DOCUMENTS

| | | | |
|---|---|---|---|
| 3,106,403 | 10/1963 | Kirkman | 473/224 X |
| 3,136,546 | 6/1964 | Connolly | 473/234 |
| 4,515,368 | 5/1985 | Petitjean | 473/224 |
| 4,969,921 | 11/1990 | Silvera | 473/234 |

*Primary Examiner*—George J. Marlo
*Attorney, Agent, or Firm*—Euggene Oak

[57] ABSTRACT

A practice golf club aids golf players in improving their stroke by indicating whether or not their swing generates an adequate amount of club head speed. This is achieved by utilizing the centrifugal force generated by a golf swing to actuate a piston located at the head of the golf club. If sufficient club head speed is attained and the piston is displaced a certain amount, a lamp momentarily blinks and an audible "click" can be heard to notify the user that the swing was indeed adequate. The components of the club include a piston, holding ball bearings, a return spring and an electrical circuit which contains a lamp and a ball bearing which is contacted by the piston when the piston is displaced by centrifugal force. The piston produces a second "click" when it is returned and strikes an upper piston chamber wall.

4 Claims, 3 Drawing Sheets

PRACTICE GOLF CLUB

BACKGROUND OF THE INVENTION

1. Field of the Invention

The present invention pertains generally to the field of sports equipment, and specifically to equipment used in the sport of golf.

2. Description of the Prior Art

In the sport of golf, developing the proper swing motion and speed is crucial in order to strike the ball accurately and drive it a certain distance. The club head speed is the measurement of the velocity of the head and thus is not an imprecise prediction of the trajectory of a golf ball. Developing club head speed while maintaining an accurate and proper swing is therefore a primary concern of professional and amateur golfers alike. Therefore there is a current need for a product which assists in the instruction of golf players in developing club head speed.

Prior art in the field of golf equipment disclose several variations of golf clubs and practice golf clubs. However, none of the prior art teaches a practice golf club which assists in developing club head speed as disclosed by the present invention.

Accordingly, the primary object of the present invention is to provide a practice golf club which assists in developing an increased club head speed.

Another object of the present invention is to provide a practice golf club which indicates when a proper club head speed is achieved by the activation of a light and an audible signal.

Yet another object of the present invention is to provide a practice golf club which is convenient to use and is relatively inexpensive to manufacture.

SUMMARY OF THE INVENTION

When swung, the practice golf club determines whether or not the swing has developed a sufficient amount of club head speed. The user is notified if the swing was adequate by the activation of a light attached to the end of the club opposite the handle and also an audible signal. If the swing is not adequate, the light is not activated and the audible signal is not heard.

The primary component of the practice golf club is a centrifugally activated piston integrally and longitudinally oriented with the shaft of the club, the piston being disposed in a casing located at the end of club opposite of its handle. When the club is swung, the piston is actuated away from the handle by the centrifugal force created by the swing. The motion of the piston activates the light and audible signal, and a spring returns the piston to its original position. The same spring prevents the piston from activating the light and audible signal without a swing having sufficient club head speed.

These together with other objects of the invention are explained clearly in the claims annexed to and forming a part of this disclosure. For a better understanding of the invention, its operating advantages and the specific objects attained by its use, reference should be made to the accompanying drawings and descriptive matter in which there are illustrated preferred embodiments of the invention.

BRIEF DESCRIPTION OF THE DRAWINGS

For a better understanding of the principle and nature of the present invention, reference should be made to the following detailed description taken in connection with the accompanying drawings in which.

DETAILED DESCRIPTION OF THE PREFERRED EMBODIMENT

Figure 1:
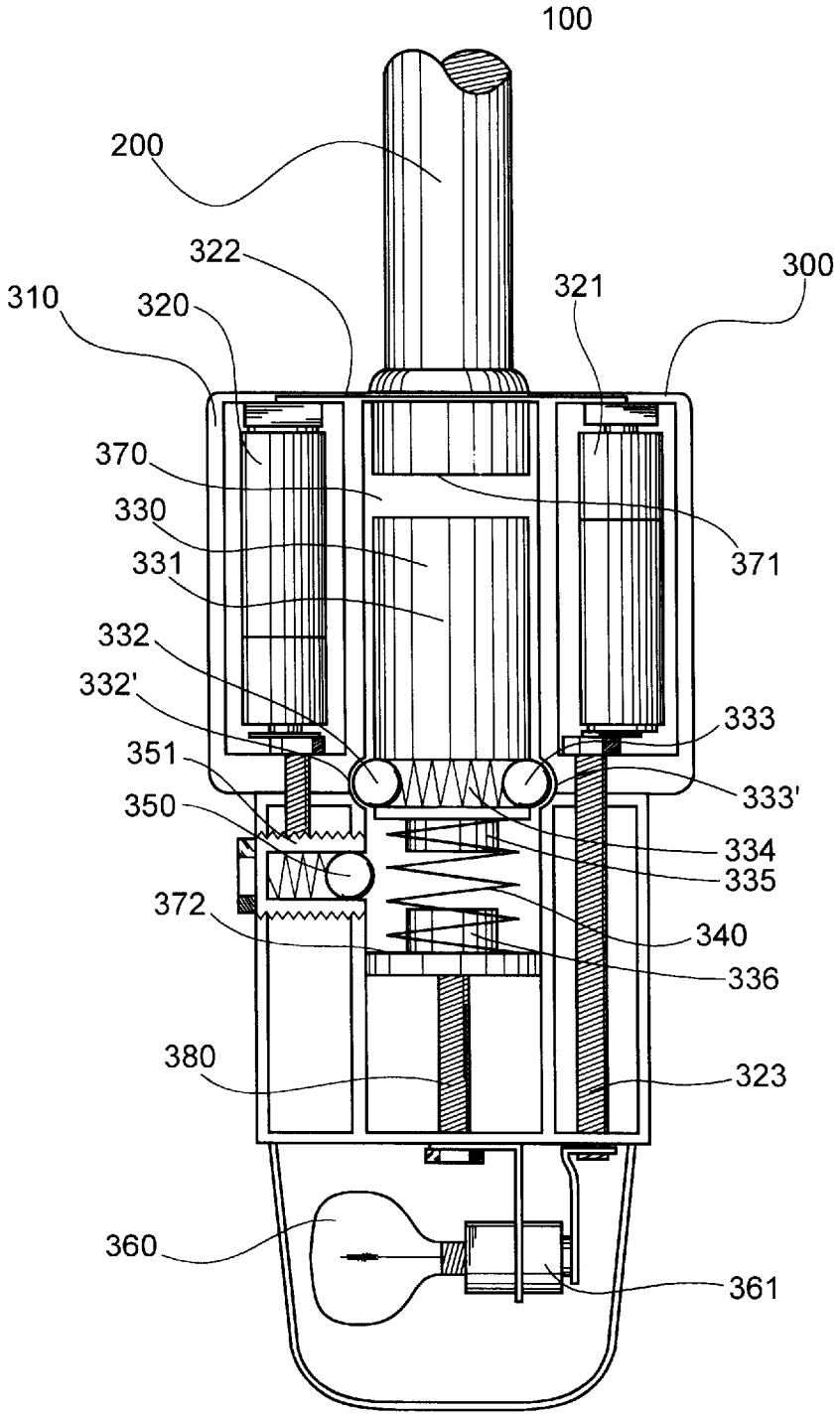
FIG. 1 is a cross-sectional side view of the present invention exposing its inner parts prior to being swung.

Referring to FIG. 1, the practice golf club 100 comprises a shaft 200, a handle (not shown) and a centrifugally-activated mechanism 300, wherein the handle and the centrifugally-activated mechanism 300 are located at opposite ends of the shaft 200. The centrifugally-activated mechanism 300 comprises a casing 310, a first and second power supply 320 and 321, a piston 330, a main spring 340, a ball bearing 350, a lamp 360, and a piston chamber 370. The piston chamber 370 is bounded by an upper piston chamber wall 371 and a lower piston chamber wall 372.

The ball bearing 350 is connected to the power supply 320 via a conduit 351, and the first power supply 320 is connected to the second power supply 321 via a conduit 322. The second power supply is connected to a lamp receptacle 361 via a conduit 323, wherein the lamp 360 is held in the lamp receptacle 361. The lamp receptacle 361 is connected to another conduit 380.

The piston 330 comprises a main shaft 331, holding ball bearings 332 and 333, a spring 334, and an upper contact conduit 335. A lower contact conduit 336 corresponds to the upper contact conduit 335. The piston 330 is disposed within the piston chamber 370 integrally and longitudinally with respect to the shaft 200 of the golf club 100, wherein the reciprocating action of the piston 330 occurs along the cylindrical axis of the shaft 200.

Figure 2:
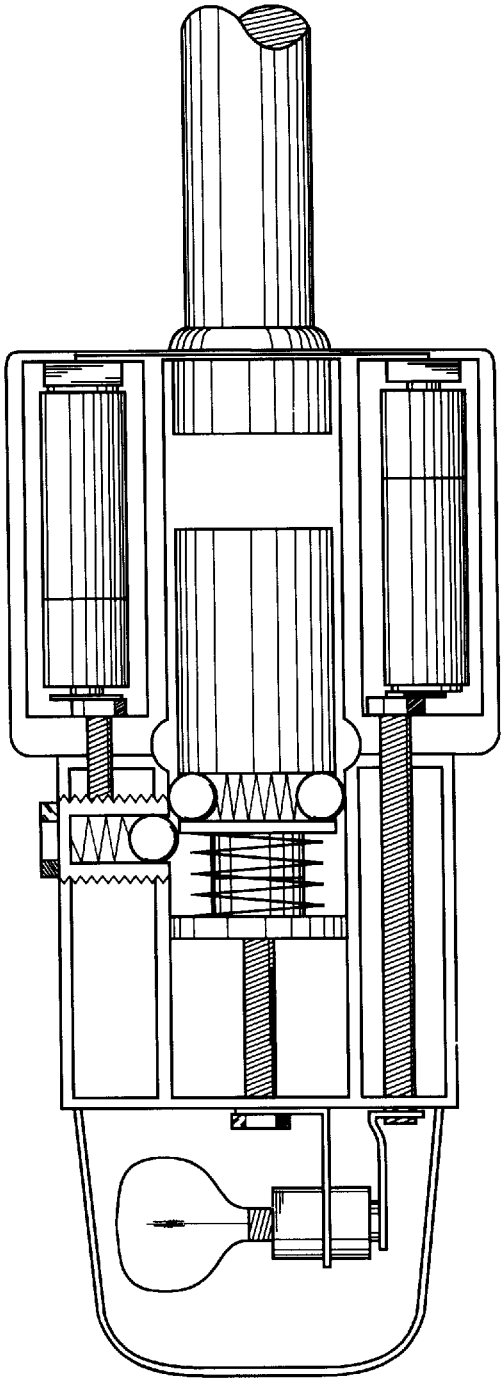
FIG. 2 is a cross-sectional side view of the present invention exposing its inner parts during a swing.

FIG. 2 depicts the present invention during a swing which generates a sufficient amount of club head speed. When the practice golf club 100 is swung, the piston 330 is propelled in an outward direction from the shaft 200 due to the centrifugal force caused by the swing. Depending upon the club head speed generated by the swing, the piston 330 is displaced a certain distance from its original position, wherein the spring 340 provides resistance and allows the piston 330 to reciprocate. The swing must first generate enough club head speed to dislodge the holding ball bearings 332 and 333 from their respective holding receptacles 332' and 333'. If the swing generates sufficient club head speed and thus if the piston 330 is adequately displaced, the upper contact conduit 335 and the lower contact conduit 336 contact each other; likewise, the ball bearing 350 and the piston 330 also come into contact, thus momentarily permitting electrical flow, and the momentary activation of the lamp 360. The audible signal is produced when the piston is displaced and the upper contact conduit 335 strikes the lower contact conduit 336. This striking between the upper contact conduit 335 and the lower contact conduit 336 creates a "click" noise. The piston 330 reciprocates from the force of impact and the force of the spring 340 and strikes the upper piston chamber wall 371, thereby producing a "double-clicking" sound.

Figure 3:
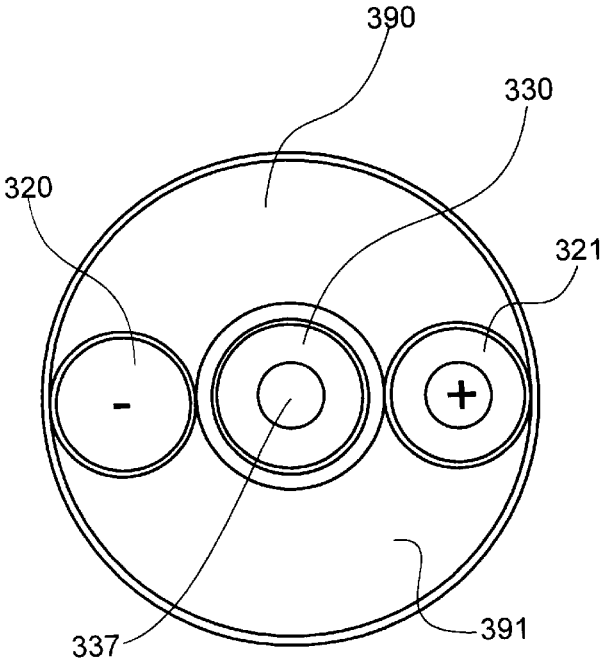
FIG. 3 is a cross-sectional top view of the centrifugally-activated mechanism of the present invention.
Figure 4:
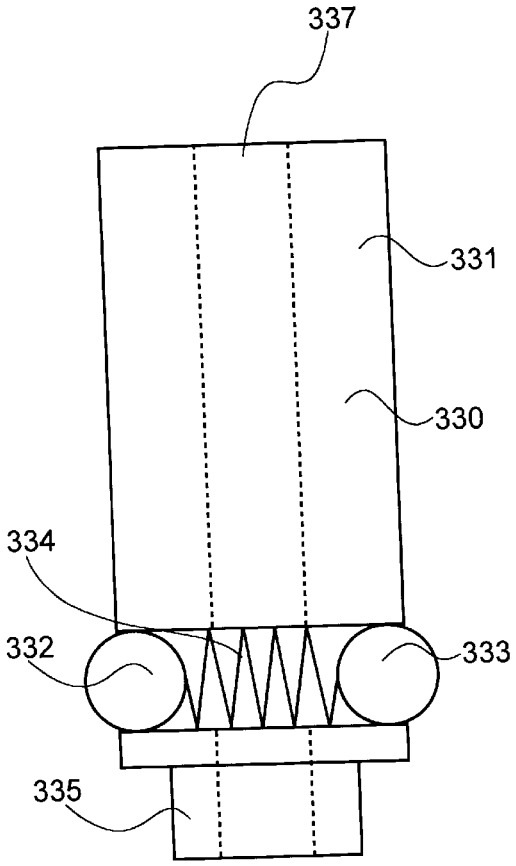
FIG. 4 is a side view of the piston depicting the longitudinal aperture.

In order for the piston 330 to reciprocate smoothly, a cylindrical bushing is inserted and is used for the inner walls of the piston chamber 370. In addition, referring to FIG. 3 which is a cross-sectional top view of the centrifugally-activated mechanism 300 and FIG. 4 which is a side view of the piston 330, a longitudinal aperture 337 is integrally and longitudinally milled through the piston 330 in order to reduce the amount of pressure resistance which opposes the piston 330 when the golf club is swung. Referring to FIG. 3, in order to weight the head of the club, lead members 390 and 391 are disposed within the casing 310.

Figure 5:
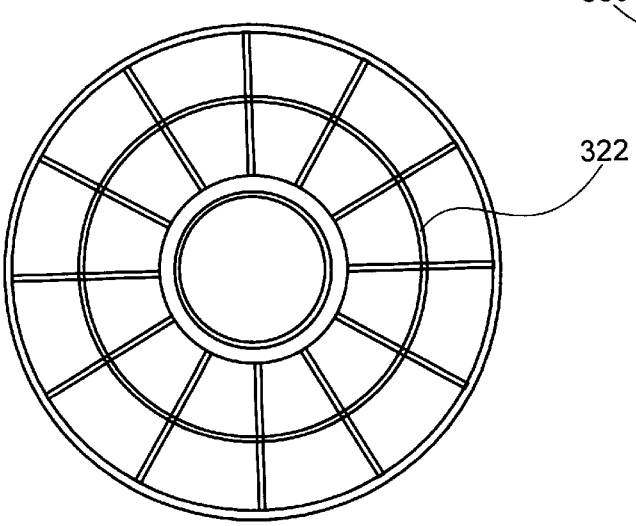
FIG. 5 is a cross-sectional top view of the electrical conduit which connects the two power supplies.

The plastic casing 310 of the centrifugally activated mechanism 300 increases the audible level of the collisions between the piston 330 and the piston chamber 370. FIG. 5 depicts the conduit 322 which connects the first power supply 320 and the second power supply 321.

In an alternate embodiment, springs are attached to the holding ball bearings 332 and 333 on the piston 330. Since the holding ball bearings 332 and 333 hold the piston in place and resist movement of the piston 330, varying the strength of the springs which maintain the holding ball bearings 332 and 333 in place will likewise vary the amount of force necessary to sufficiently displace the piston 330 to cause the activation of the lamp and the audible signal.

What is claimed as being new and therefore desired to be protected by Letters Patent of the United States is as follows:

1. A practice golf club comprising:

a) a shaft having a first end, a second end, and an axis integrally positioned and extending longitudinally along said shaft;

b) a handle affixed to said first end of said shaft;

c) a centrifugally-activated mechanism affixed to said second end of said shaft opposite of said handle comprising:

1) a piston disposed in a piston chamber, said piston integrally and longitudinally positioned with respect to said axis of said shaft;

a. reciprocating action of said piston occurring along said axis of said shaft;

b. a plurality of holding ball bearings attached to said piston accommodated by a plurality of holding receptacles disposed on an inner wall of said piston chamber to restrict movement of said piston without ample centrifugal force;

2) said piston chamber having an upper piston chamber wall and a lower piston chamber wall;

3) a spring disposed between said piston and said lower piston chamber wall;

4) a lower contact conduit connected to said lower piston chamber wall, an upper contact conduit connected to the bottom of said piston, wherein the diameter of said lower contact conduit and said upper contact conduit are significantly smaller than diameter of said piston, wherein the diameter of said spring is larger than said diameters of said upper contact conduit and said lower contact conduit but smaller than diameter of said piston, allowing said upper and lower contact conduits to be inserted into each end of said spring thereby securing said spring between said piston and said lower piston chamber wall;

5) a power supply;

6) said power supply connected to a lamp receptacle via an electrical conduit, wherein said lamp receptacle accommodates a lamp;

7) said lamp receptacle connected to said lower piston chamber wall via an electrical conduit, said lower piston chamber wall connected to said lower contact conduit;

8) said power supply connected to a ball bearing via an electrical conduit, wherein when said practice golf club is swung generating sufficient centrifugal force, said plurality of holding ball bearings are loosened from said plurality of said holding receptacles, said piston is propelled away from said shaft and said upper contact conduit strikes said lower contact conduit, said piston comes into contact with said ball bearing, thereby allowing electricity to flow momentarily and activating said lamp momentarily, said spring causing said piston to reciprocate and strike against said upper piston chamber wall, thereby producing an audible sound to indicate the user of proper swing.

2. A practice golf club as mentioned in claim 1, wherein said electrical conduits are screws.

3. A practice golf club as mentioned in claim 1, wherein an aperture extends transversely through said piston proximally to the position of said plurality of holding ball bearings, wherein a spring is inserted into said aperture and two of said holding ball bearings are inserted into said aperture, one at each end, compressing said spring; wherein varying the size of said spring varies the amount of force required to dislodge said two holding ball bearings from said plurality of holding receptacles.

4. A practice golf club as mentioned in claim 1, wherein said power supply is a plurality of AAA-sized 1.2 Volt batteries.

* * * * *